US005437407A

United States Patent [19]

Kim

[11] Patent Number: 5,437,407

[45] Date of Patent: Aug. 1, 1995

[54] DETERGENT PACKING PAPER BOX

[75] Inventor: Do Wook Kim, Seoul, Rep. of Korea

[73] Assignee: Dae Young Packing Co., Ltd., Kyungki-Do, Rep. of Korea

[21] Appl. No.: 272,478

[22] Filed: Jul. 11, 1994

[30] Foreign Application Priority Data

Apr. 11, 1994 [KR] Rep. of Korea ..... 94-7511

[51] Int. Cl.[6] ..... B65D 5/54

[52] U.S. Cl. ..... 229/225; 229/117.22; 229/117.24; 229/206

[58] Field of Search ..... 229/117.22, 117.24, 229/206, 224, 225

[56] References Cited

U.S. PATENT DOCUMENTS

| | | | |
|---|---|---|---|
| 2,011,438 | 8/1935 | Daller | 229/225 |
| 2,836,343 | 5/1958 | Will | 229/225 |
| 3,360,112 | 12/1967 | Johnson | 229/117.22 |
| 3,951,333 | 4/1976 | Forbes, Jr. et al. | 229/260 |
| 4,865,203 | 9/1989 | Ueda | 229/206 |
| 4,913,292 | 4/1990 | Field | 229/117.24 |
| 5,031,825 | 7/1991 | Romagnoli | 229/225 |

FOREIGN PATENT DOCUMENTS

| | | | |
|---|---|---|---|
| 2514324 | 4/1983 | France | 229/225 |
| 3140389 | 6/1983 | Germany | 229/225 |
| 2262508 | 6/1993 | United Kingdom | 229/117.22 |

*Primary Examiner*—Gary E. Elkins
*Attorney, Agent, or Firm*—Morgan & Finnegan

[57] ABSTRACT

A paper box for packing detergent which is provided at a side with a tear tape so as to be partially opened so that the paper box can be carried stably and opened easily. The paper box has four vertical wall members, top members extended from the vertical wall members, bottom members extended from the vertical wall members, a tear tape portion formed at upper portions of three vertical wall members selected from the four vertical wall members and beginning at a nail inserting hole formed at a middle portion of any of the vertical wall members, passing through the adjacent vertical wall member and terminating in a middle portion of the adjacent vertical wall member; and an inlet attached to inner surfaces of the three vertical wall members so as to cover the tear tape portion.

6 Claims, 6 Drawing Sheets

DETERGENT PACKING PAPER BOX

BACKGROUND OF THE INVENTION

1. Field of the Invention

The present invention relates to a paper box for packing detergent of powder or particles, and more particularly to an improved detergent packing paper box which is provided at a side with a tear tape so as to be partially opened so that the paper box can be carried stably and opened easily.

2. Description of the Prior Art

Since a paper box which is used to pack detergent etc., must usually preserve detergent for a long time in view of distribution time of the product and exhaustion time of the content, it is required to have durability such as impact resistance and watertightness.

In other words, the above box has problems as follows. Since the detergent packed in the box is made of fine particles, it is easily agglomerated upon contact with air or humidity penetrated from outside. In addition, the paper box is apt to be broken by impact applied from outside and thus the content in the box is poured through the broken part.

Accordingly, the detergent packing paper box is provided at its inner surface with an inlet such that the inlet covers the tear tape portion in order to improve its durability and prevent penetration of air.

A prevalent method for providing the inlet includes a method of inserting only the inlet or with rivets, pouring detergent into a paper box and attaching tightly the inlet to a box surface by weight of the detergent contained the box, a method of supplying a cardboard blank adapted to form a box body and an inlet in the same direction to form a sheet of cardboard integrated with the inlet and shaping the integrated cardboard into a box, or a method of preparing a cardboard having four main walls 11, 12, 13 and 14 and three subsidiary walls 15, 16 and 17 and folding the subsidiary walls 15, 16 and 17 inward to define an inlet 20, as shown in FIG. 1.

However, since the inlet 20 formed by the last method is overlapped in its whole surface with an inner surface of a box body 10, the box is unnecessarily increased in its weight and an additional procedure for fixing the inlet 20 is required, thereby lowering productivity.

The box body 10 may be also provided with a hand strap for facilitating its handling during distribution. The above hand strap is usually attached to a top or an upper part of a front side of the box body 10. Accordingly, when the tear tape 22 formed at the upper part of the box body 10 is torn out of the box body to open the box, a lid part with the hand strap 21 attached thereto is turned over to one side, so that the center of gravity of the overall box is biased to the side, thereby losing the balance.

As shown in FIG. 2, the hand strap 21 may be alternatively attached to an upper portion of side walls of the body 10 by means of rivets 25. Hence, the paper box is considerably troublesome in carriage and loading of the box due to the protruded hand strap 21.

In other words, since the hand strap 21 turned over to one side of the box body 10 or protruded upward from the box body 10 is interposed between the loaded paper boxes, the paper box occupies large space. Furthermore, since the detergent contained the box is early agglomerated by contact with outer air penetrated through rivet holes, it is actually impossible to preserve the detergent for a long time. Although the detergent may be contained in a vinyl envelope and packed in the box, the vinyl envelope is frequently damaged by the protruded rivet portions. Hence, it is actually difficult to expect high reliance for detergent preservation.

What is the most important is that the hand strap 21 attached to the box 10, the rivets 25 and the vinyl envelope containing the detergent are made of material bringing about environmental pollution.

If the above paper box 10 with the pollutive material is discarded as it is, the material causes devastation of soil and environmental pollution. Hence, the most important public solution for modern human beings is to endeavor to reuse material resources and to get rid of the cause of environmental pollution.

For this purpose, strict separation and recovery of waste material and use of reproduced product are recommended, but an additional work for classifying the waste material by kinds is required to reuse the collected waste material. Particularly, if relatively hard substance such as the rivet 25 is introduced into a reproducing machine, the expensive reproducing machine is easily worn out. In practice, however the reproduction of waste material and the reuse of material resources are not carried out efficiently.

SUMMARY OF THE INVENTION

The present invention has been made in view of the above-described problems occurring in the prior art and an object of the invention is to provide an improved paper box which does not incorporate foreign substance causing environmental pollution but is made of only reproducible paper so that the box can be perfectly reused after use.

Another object of the present invention is to provide a paper box which is selectively opened in its partial portion so that the box can be stably carried even though after the box is opened.

In accordance with the present invention, the object mentioned above can be accomplished by providing a paper box for packing detergent having four vertical wall members, top members extended from upper ends of the vertical wall members and bottom members extended from lower ends of the vertical wall members, said paper box comprising: a tear tape portion formed at upper portions of three vertical wall members selected from the four vertical wall members, the tear tape portion beginning at a nail inserting hole formed at a middle portion of any of the vertical wall members, passing through the adjacent vertical wall member and terminating in a middle portion of the adjacent vertical wall member; and an inlet attached to inner surfaces of the three vertical wall members such that the inlet covers the tear tape portion.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

An embodiment according to a paper pack of the present invention will be described with reference to the accompanying drawings hereinafter.

Figure 1:
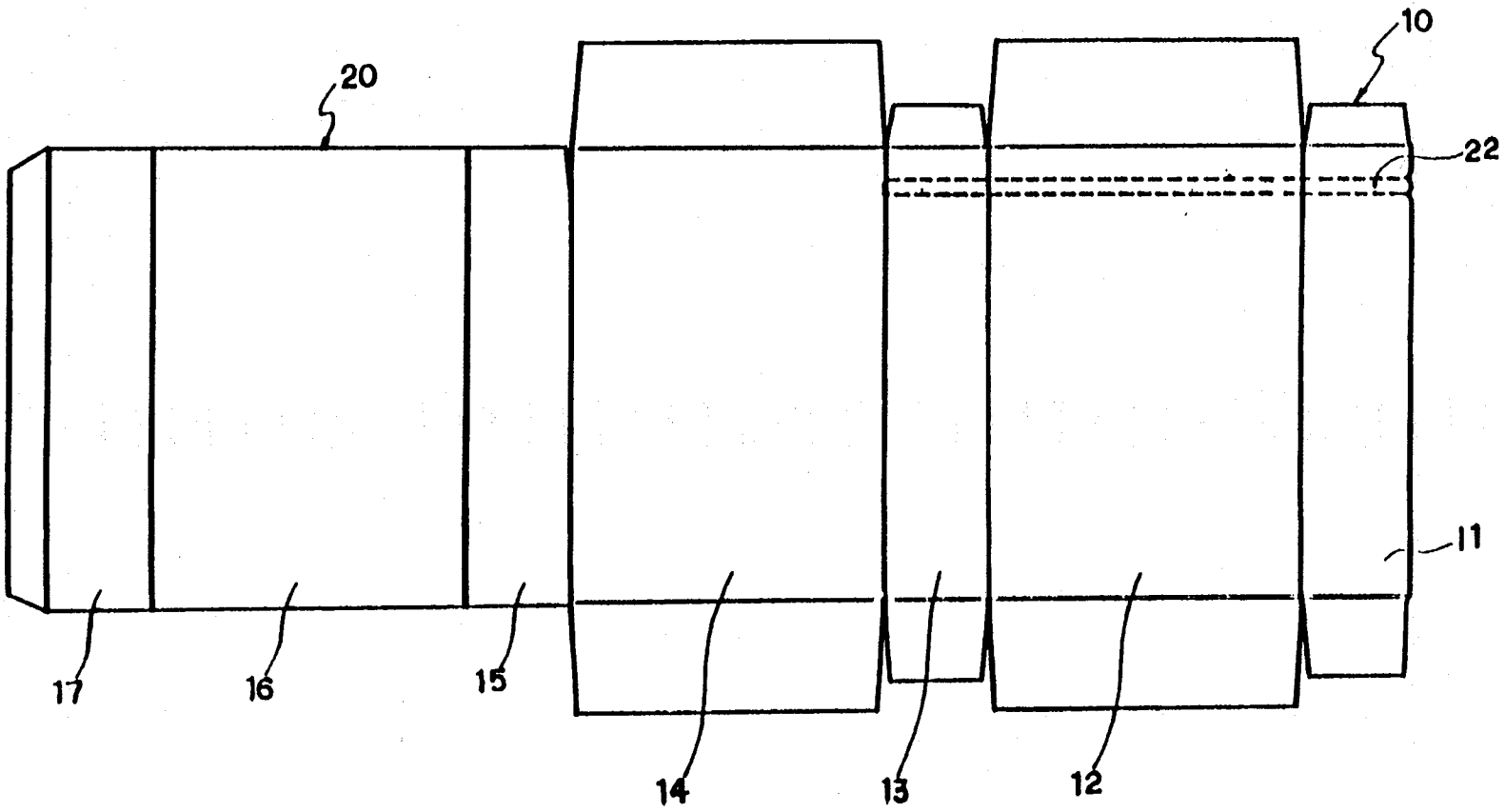
FIG. 1 (PRIOR ART)
FIG. 1 is a development view of a conventional paper box.
Figure 2:
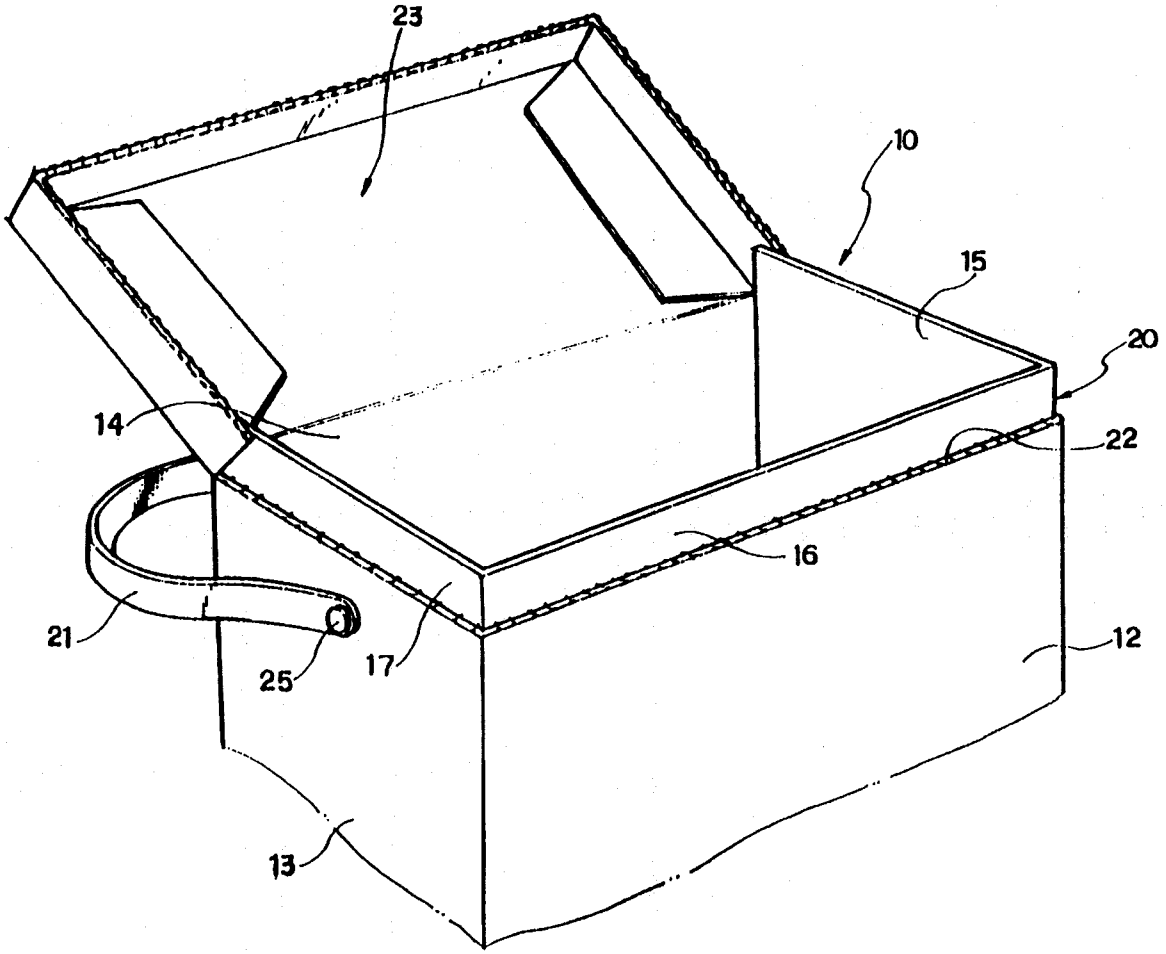
FIG. 2 (PRIOR ART)
FIG. 2 is a perspective view showing an using state of the paper box of FIG. 1.
Figure 3:
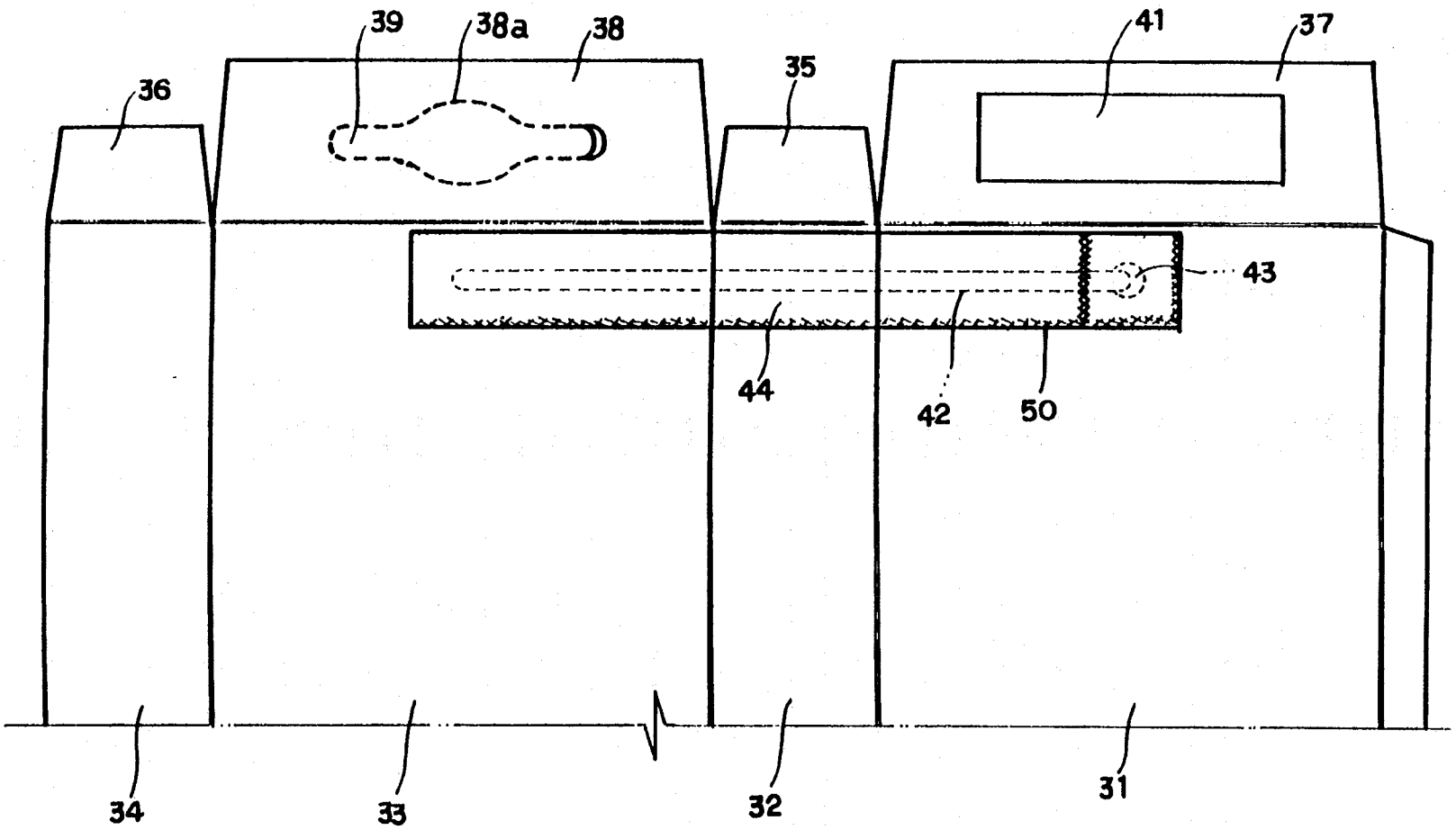
FIG. 3 is a development view of a paper box according to the present invention.
Figure 4:
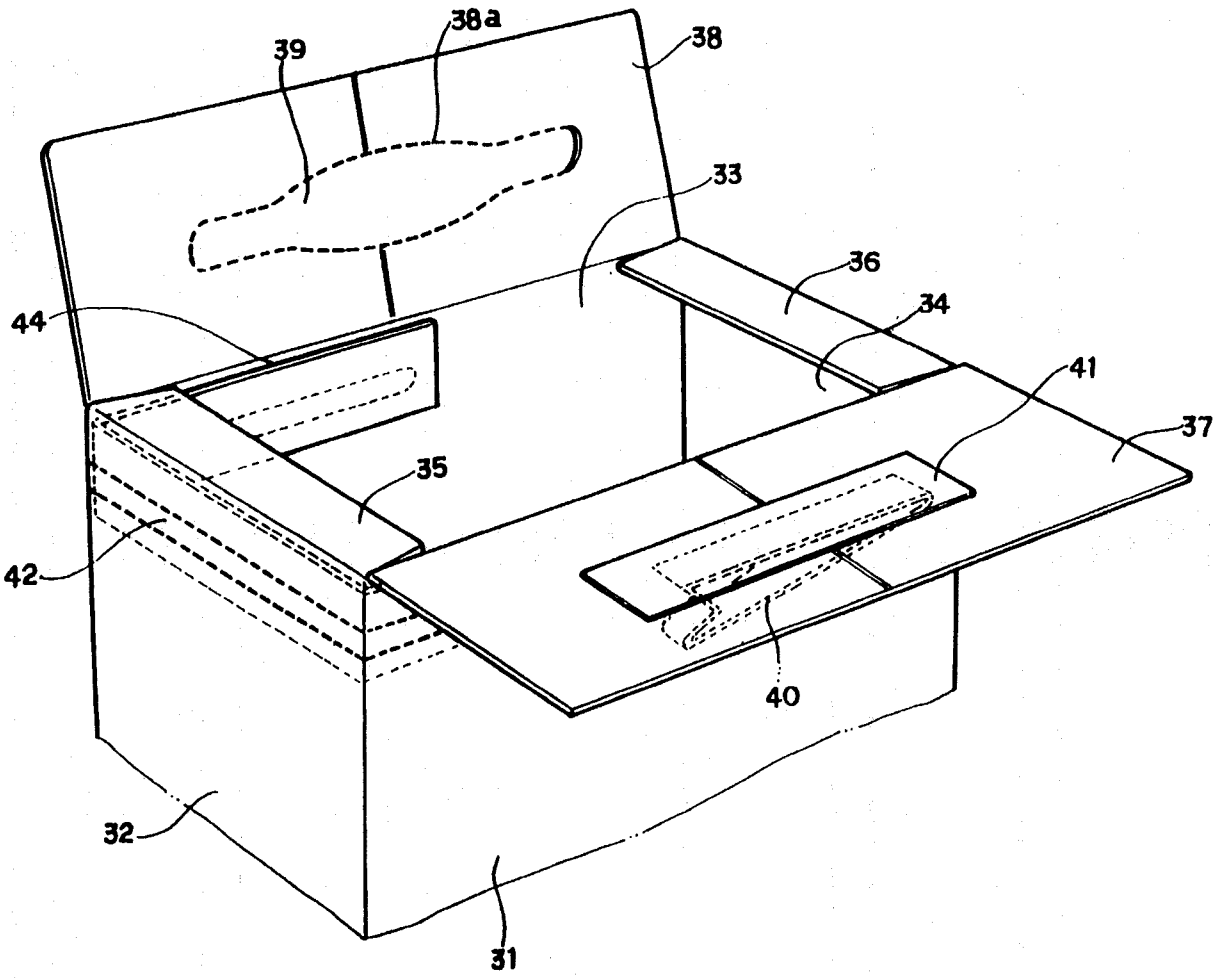
FIG. 4 is a perspective view of the paper box of FIG. 3 wherein top members are developed.
Figure 5A:
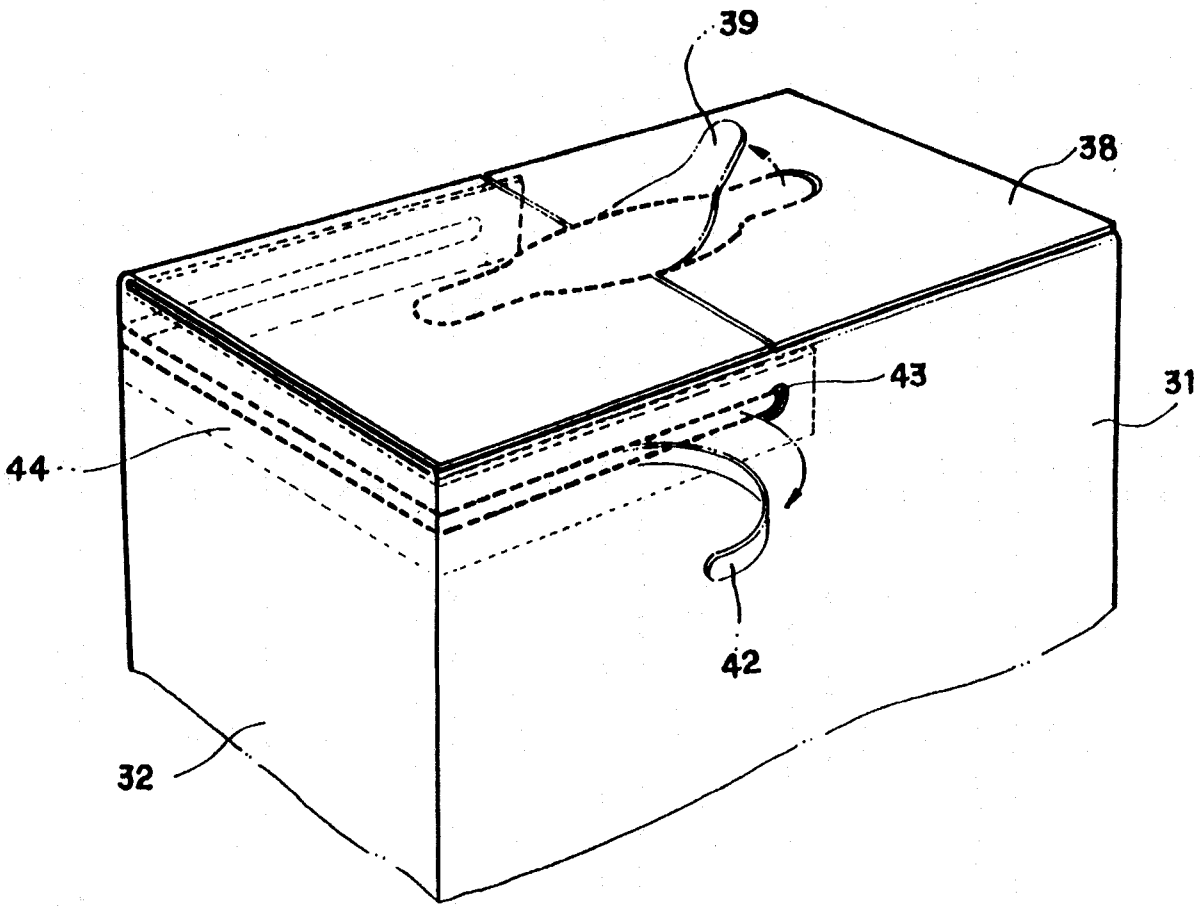
FIG. 5A is a perspective view showing an using state of the paper box according to the invention wherein a lid part is closed.
Figure 5:
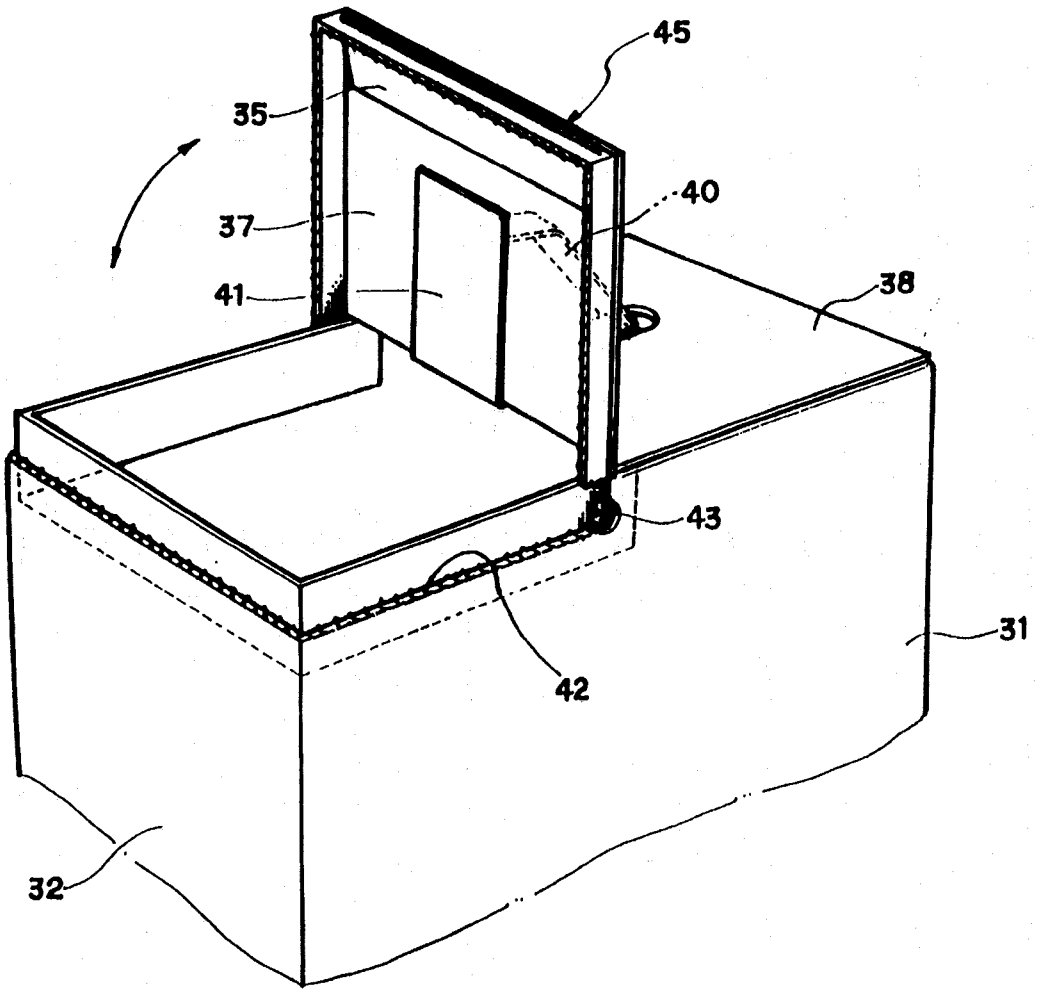
FIG. 5B is a view similar to FIG. 5A wherein a lid part is opened.

FIG. 3 is a development view of a paper box according to the invention, FIG. 4 is a perspective view of the paper box of FIG. 3 which is opened in its upper part, and FIGS. 5A and 5B are perspective views showing using states of the paper box of the invention.

As illustrated in the drawings, the paper box of the invention comprises four vertical wall members 31, 32, 33 and 34, a pair of flap members 35 and 36 extended from upper ends of the vertical wall members 32 and 24 and inner and outer lid members 37 and 38 extended from upper ends of the vertical wall members 31 and 33 and adapted to be disposed onto the flap members 35 and 36, in similar to an usual paper box.

The flap members 35 and 36 extended from the side vertical wall members 32 and 34 have certain widths such that the flap members 35 and 36 are attached to the inner lid member 37. The inner lid member 37 is provided at its middle portion with an internal strap 40 attached thereto. The paper strap 40 to be concealed is integrally formed with a strap fixing plate 41. More specifically stated, the inner lid member 37 is formed at its middle portion with a rectangular cutout portion and the strap fixing plate 41 is attached to an inner surface of the inner lid member 37 such that the strap fixing plate 41 closes the cutout portion. Accordingly, the strap 40 can be spread upward if desired. The paper strap 40 is covered up by the outer lid member 38.

The outer lid member 38 extended from the rear vertical wall member 33 is integrally formed at its middle portion with a strap cover 39 and the strap cover 39 is defined by a perforated line 38*a*. When the paper strap 40 is necessary to be used, the strap cover 39 is cut off to expose the paper strap 40 to outside.

The three predetermined vertical wall members 31, 32 and 33 selected from the four vertical wall members 31, 32, 33 and 34 are formed at its upper portions with a tear tape portion 42. The tear tape portion 42 is extended between middle portions of the front and rear vertical wall members through the side vertical wall member 32 or 34 interposed therebetween.

In other words, the tear tape portion 42 begins at a nail inserting through hole 43 perforated at a middle portion of the front vertical wall member 31, passes through the side vertical wall member 32 and terminates in a middle portion of the rear vertical wall member 33, as illustrated in the accompanying drawings.

Since the tear tape portion 42 begins at a middle portion of the front vertical wall member 31 and terminates in a middle portion of the rear vertical wall member 33, the half lid portion 45 which is cut off and turned over by the tear tape 42 can be maintained in a stable state.

The starting point of the tear tape 42 is determined according to size of the half lid portion 45 and may be thus positioned at $\frac{1}{2}$ or $\frac{1}{3}$ of the width of the front and rear vertical wall member according to size of the paper box.

In formation of the tear tape 42, the tear tape portion 42 can be also alternatively constructed such that the tear tape portion begins at a middle portion or a front portion of the side vertical wall member 32 and terminates in a middle portion of the other side vertical wall member 34 through the front vertical wall member 31 so that a front part of the lid member is turned over rearward.

It is preferable that the nail inserting through hole 43 formed at the starting point of the tear tape 42 have an enough size to receive a nail tip. Due to presence of the nail inserting through hole 43, outer air is easily introduced into the paper box through the nail inserting through hole 43, thereby causing the detergent content in the box to be agglomerated. In order to overcome the above agglomeration problem, a strip-shaped inlet 44 which has an enough size to close the tear tape 42 is attached to an inner surface of the box body. At this time, adhesive for attaching the inlet to the box is applied to a portion of the inlet 44 around the nail inserting through hole 43 to prevent introduction of outer air and also applied along a lower side of the inlet (see FIG. 3).

However, the above-mentioned method for attaching the inlet 44 requires an additional attaching process and a perfect hermetical seal for the nail through hole 43. In order to facilitate the inlet attaching process, the inlet 44 may be applied only along its a lower side with adhesive and attached to an inner surface of the box to cover the tear tape portion 42. Thereafter, the nail inserting through hole 43 is sealed by attaching a separate adhesive tape (not shown) to an outer surface of the box.

In addition, if the box body has an enough thickness to maintain strength and shape of the box and support the detergent content in the box, it is not necessary to attach the separate inlet 44 to an inner surface of the box and only the tear tape portion 42 may be formed at the box body. In this instance, the nail inserting through hole 43 may be alternatively formed into a dotted line so as to prevent outer air from being introduced through the through hole. In case of the tear tape having the dotted line, when the user pushes the end of the tear tape by his finger to remove the tear tape, the end of the tear tape is cut off and pushed inward so that a desired through hole is provided at the position according to that of the end of the tear tape.

Assembling process of the above-constructed detergent packing paper box will now be described. As again shown in FIG. 3, the tear tape portion 42 is formed at upper portions of the three vertical wall members by a perforated line and the nail inserting through hole 43 is formed at the starting point of the tear tape 42. Thereafter, the inlet 44 is attached to the inner surface of the box body such that the tear tape portion 42 is efficiently covered with the inlet 44. Bottom flap members and a side flap member are attached by adhesive such that a detergent receiving space is defined by the vertical and the bottom members, similarly to the usual assembling process. Subsequently, the detergent receiving space is filled with a predetermined amount of detergent. The flap members 35 and 36 extended from the side vertical wall members 32 and 34 are folded inward and the flap members 35 and 36 are applied at the outer surfaces with a predetermined width of adhesive. Then, the inner lid member 37 attached with the paper strap attached thereto and the outer lid member 38 formed with the strap cover 39 are folded inward and hermetically attached to the adhesive applied to the outer surface of the flap members 35 and 36, thereby providing a desired paper box.

Since the paper box assembled in this manner maintains impact resistance and watertightness, it is possible to prevent agglomeration of detergent occurring during transportation and distribution of the product.

In use of the above-constructed paper box, the user inserts his finger into the nail inserting through hole 43 and pulls the end of the tear tape portion 42 to cut off the tear tape. The upper part of the paper box formed by cutting off the tear tape is turned over upward, thereby providing a half lid part 45 corresponding to the length of the tear tape 42.

Since the paper box is provided with the high waterproof inlet 44 attached to the inside of the upper end of the cut box to close the cut tear tape portion, it is possible to reduce maximally introduction of outer air and to prevent the half lid part 45 from being incidentally opened when the half lid part 45 is opened and closed or the paper box is kept with the closed half lid part.

In accordance with the above embodiment of the invention, although the tear tape portion begins at a middle portion of the vertical wall member, thereby allowing a half of the outer lid member 38 to be turned over, it is to be understood that the starting and end points of the tear tape portion defining the size of the half lid part 45 are not limited to the above embodiment.

That is, the position and the size of the lid part 45 formed by the tear tape 42 may be appropriately changed according to the size of the paper box and its application and there is also no reason that the position of the paper strap 40 protruded from the outer lid member 38 is limited. In order to practice the invention efficiently, the paper strap 40 may be positioned at a location remote from the lid part 45 so that the paper box can be stably carried by the strap even when the lid part 45 is opened.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A paper box for packing detergent having four vertical wall members, top members extended from upper ends of the vertical wall members and bottom members extended from lower ends of the vertical wall members, said paper box comprising:

a tear tape portion formed at upper portions of a first, a second and a third vertical wall members selected from the four vertical wall members, the tear tape portion beginning at a nail inserting hole formed at a middle part of the upper portion of the first vertical wall member, passing through the second vertical wall member and terminating in a middle part of the upper portion of the third vertical wall member; and the first vertical wall member formed with the nail inserting hole has a detachable tape attached thereto such that the nail inserting hole is hermetically sealed.

2. A paper box for packing detergent having four vertical wall members, top members extended from upper ends of the vertical wall members and bottom members extended from lower ends of the vertical wall members, said paper box comprising:

a tear tape portion formed at upper portions of a first, a second and a third vertical wall members selected from the four vertical wall members, each vertical wall member having an inner surface, the tear tape portion beginning at a nail inserting hole formed at a middle part of the upper portion of the first vertical wall member, passing through the second vertical wall member and terminating in a middle part of the upper portion of the third vertical wall member; and a strip shaped inlet attached to the inner surfaces of the first, the second and the third vertical wall members such that the inlet covers the tear tape portion.

3. A paper box according to claim 2, said paper box having a front vertical wall member, a side vertical wall member and a rear vertical wall member, each said vertical wall member having a middle portion, wherein the tear tape portion beginning at the nail inserting hole formed at a middle portion of the front vertical wall members, passes through the adjacent side vertical wall member and terminates in the middle portion of the adjacent rear vertical wall member.

4. A paper box according to claim 2, further comprising:

a hand strap;

a first top member and a corresponding top member selected from the group of the four top members, said first top member having an outer surface; and a removable strap cover, said hand strap attached to the outer surface of the first top member and the corresponding top member is integrally formed with the removable strap cover so as not to expose the hand strap.

5. A paper box according to claim 2, wherein the vertical wall member formed with the nail inserting hole has a detachable tape attached thereto such that the nail inserting hole is hermetically sealed.

6. A paper box according to claim 2, wherein an inlet for covering both the tear tape portion and the nail inserting hole is attached to the inner surface of the vertical wall member proximal to the nail inserting hole, said inlet attached at its lower side.

* * * * *